US011141845B2

(12) United States Patent
Taylor et al.

(10) Patent No.: US 11,141,845 B2
(45) Date of Patent: Oct. 12, 2021

(54) COMBUSTION-POWERED TOOL WITH SLEEVE-RETAINING LOCKOUT DEVICE

(71) Applicant: Illinois Tool Works Inc., Glenview, IL (US)

(72) Inventors: Walter Taylor, McHenry, IL (US); Julius Schwartzenberger, Northlake, IL (US)

(73) Assignee: Illinois Tool Works Inc., Glenview, IL (US)

( * ) Notice: Subject to any disclaimer, the term of this patent is extended or adjusted under 35 U.S.C. 154(b) by 315 days.

(21) Appl. No.: 15/875,626

(22) Filed: Jan. 19, 2018

(65) Prior Publication Data

US 2018/0215023 A1 Aug. 2, 2018

Related U.S. Application Data

(60) Provisional application No. 62/453,813, filed on Feb. 2, 2017.

(51) Int. Cl.
*B25C 1/08* (2006.01)

(52) U.S. Cl.
CPC ..... *B25C 1/08* (2013.01)

(58) Field of Classification Search
CPC ..... B25C 1/008; B25C 1/08
USPC ..... 227/8, 9, 10, 107, 136, 140; 123/46 R, 123/198 E, 465 C
See application file for complete search history.

(56) References Cited

U.S. PATENT DOCUMENTS 4,405,072 A * 9/1983 Kindle ..... B25C 1/08 227/10
4,483,280 A * 11/1984 Nikolich ..... F02B 63/02 123/46 SC
4,483,473 A * 11/1984 Wagdy ..... F02P 11/04 123/46 SC
4,483,474 A * 11/1984 Nikolich ..... B25C 1/008 123/46 SC
5,197,646 A * 3/1993 Nikolich ..... B25C 1/008 123/46 SC
6,145,724 A * 11/2000 Shkolnikov ..... B25C 1/08 227/8
6,592,014 B2 7/2003 Smolinski
6,705,501 B2 3/2004 Miller et al.
(Continued)

FOREIGN PATENT DOCUMENTS

WO WO 2008/048294 4/2008

OTHER PUBLICATIONS

International Search Report and Written Opinion for International Application No. PCT/US2018/014862, dated May 28, 2018 (11 pages).

*Primary Examiner* — Thanh K Truong
*Assistant Examiner* — David G Shutty
(74) *Attorney, Agent, or Firm* — Neal, Gerber & Eisenberg LLP

(57) ABSTRACT

The present disclosure provides various embodiments of a combustion-powered-fastener-driving tool that include a lockout device to ensure the tool's valve sleeve doesn't move to an unsealed position and the tool's combustion chamber remains sealed until the piston returns to the pre-firing position. The lockout device is engageable with a lockout device engaging member operably connected to the tool's trigger, which gives the operator direct control over locking the valve sleeve in the unsealed position.

14 Claims, 9 Drawing Sheets

(56) References Cited

U.S. PATENT DOCUMENTS

| | | | | |
|---|---|---|---|---|
| 6,715,655 | B1 * | 4/2004 | Taylor | B25C 1/08 227/10 |
| 6,783,045 | B2 * | 8/2004 | Shima | B25C 1/08 227/10 |
| 6,966,476 | B2 | 11/2005 | Jalbert et al. | |
| 7,467,739 | B2 * | 12/2008 | Fujisawa | B25C 1/08 227/10 |
| 7,673,779 | B2 * | 3/2010 | Moeller | B25C 1/08 227/10 |
| 8,511,527 | B2 * | 8/2013 | Ho | B25C 1/008 227/8 |
| 8,770,456 | B2 * | 7/2014 | Moeller | B25C 1/08 227/2 |
| 8,915,415 | B2 * | 12/2014 | Yokochi | B25C 1/008 227/10 |
| 9,114,516 | B2 | 8/2015 | Porth | |
| 9,636,811 | B2 | 5/2017 | Segura | |
| 2007/0194075 | A1 * | 8/2007 | Tanaka | B25C 1/08 227/8 |

* cited by examiner

COMBUSTION-POWERED TOOL WITH SLEEVE-RETAINING LOCKOUT DEVICE

PRIORITY

This application claims priority to and the benefit of U.S. Provisional Patent Application Ser. No. 62/453,813, filed Feb. 2, 2017, the entire contents of which are incorporated herein by reference.

BACKGROUND

The present disclosure relates to powered fastener-driving tools. Generally, powered fastener-driving tools employ one of several types of power sources to drive a fastener (such as a nail or a staple) into a workpiece. More specifically, a powered fastener-driving tool uses a power source to drive a piston carrying a driver blade through a cylinder from a pre-firing position to a firing position. As the piston moves to the firing position, the driver blade travels through a nosepiece, which guides the driver blade to contact a fastener housed in the nosepiece. Continued movement of the piston through the cylinder toward the firing position forces the driver blade to drive the fastener from the nosepiece into the workpiece. The piston is then forced back to the pre-firing position in a way that depends on the tool's construction and the power source the tool employs. A fastener-advancing device forces another fastener from a magazine into the nosepiece, and the tool is ready to fire again.

Combustion-powered-fastener-driving tools are one type of powered fastener-driving tool. A combustion-powered-fastener-driving tool uses a small internal combustion assembly as its power source. For a typical combustion-powered-fastener-driving tool, when an operator depresses a workpiece-contact element of the tool onto a workpiece to move the workpiece-contact element from an extended position to a retracted position, one or more mechanical linkages cause: (1) a valve sleeve to move to a sealed position to seal a combustion chamber that is in fluid communication with the cylinder; and (2) a fuel delivery system to dispense fuel from a fuel canister into the (now sealed) combustion chamber.

The operator then pulls the trigger to actuate a trigger switch, thereby causing a spark plug to spark and ignite the fuel/air mixture in the combustion chamber. This generates high-pressure combustion gases that expand and force the piston to move through the cylinder from the pre-firing position to the firing position, thereby causing the driver blade to contact a fastener housed in the nosepiece and drive the fastener from the nosepiece into the workpiece. Just before the piston reaches the firing position, the piston passes exhaust check valves defined through the cylinder, and some of the combustion gases that propel the cylinder exhaust through the check valves to atmosphere. This combined with heat exchange to the atmosphere and the fact that the combustion chamber remains sealed during firing generates a vacuum pressure above the piston and causes the piston to retract to the pre-firing position. When the operator removes the workpiece-contact element from the workpiece, a spring biases the workpiece-contact element from the retracted position to the extended position, causing the one or more mechanical linkages to move the valve sleeve to an unsealed position to unseal the combustion chamber.

Operation of a conventional combustion-powered-fastener-driving tool can be adversely affected if the valve sleeve moves and the combustion chamber unseals before the piston returns to the pre-firing position. For instance, assume the operator removes the workpiece-contact element from the workpiece after firing but before the piston returns to the extended position. This causes the valve sleeve to move to the unsealed position and unseal the combustion chamber. When this happens, the vacuum pressure is lost. This could cause the piston to stop before reaching the pre-firing position, which in turn could cause the tool to malfunction the next time the operator attempts to use the tool to drive a fastener.

There is a need for new and improved combustion-powered-fastener-driving tools that solve these problems.

SUMMARY

The present disclosure provides various embodiments of a combustion-powered-fastener-driving tool that solve the above problems by including a lockout device to ensure the valve sleeve doesn't move to an unsealed position and the combustion chamber remains sealed until the piston returns to the pre-firing position. The lockout device is engageable with a lockout device engaging member operably connected to the tool's trigger, which gives the operator direct control over locking the valve sleeve in the sealed position.

In one embodiment, the combustion-powered-fastener-driving tool includes a housing, a valve sleeve at least partially within the housing, a trigger supported by the housing, a retainer pin, a retainer pin receiver, and a retainer pin contact member. The valve sleeve is movable relative to the housing between an unsealed position (in which the combustion chamber is unsealed so firing is not enabled) and a sealed position (in which the combustion chamber is sealed to enable firing). The trigger is movable relative to the housing between an extended position and a retracted position. The retainer pin is also movable relative to the housing between a retracted position and an engaged position.

The retainer pin contact member is positioned relative to the retainer pin and operably connected to the trigger such that, when the valve sleeve is in the sealed position and the trigger moves from the extended position to the retracted position, the retainer pin contact member engages the retainer pin and moves the retainer pin from the retracted position to the engaged position. This causes that part of the retainer pin to be received by the retainer pin receiver. When this part of the retainer pin is received in the retainer pin receiver, it prevents the valve sleeve from moving from the sealed position to the unsealed position.

Additional features and advantages are described in, and will be apparent from, the following Detailed Description and the Figures.

DETAILED DESCRIPTION

Figure 1:
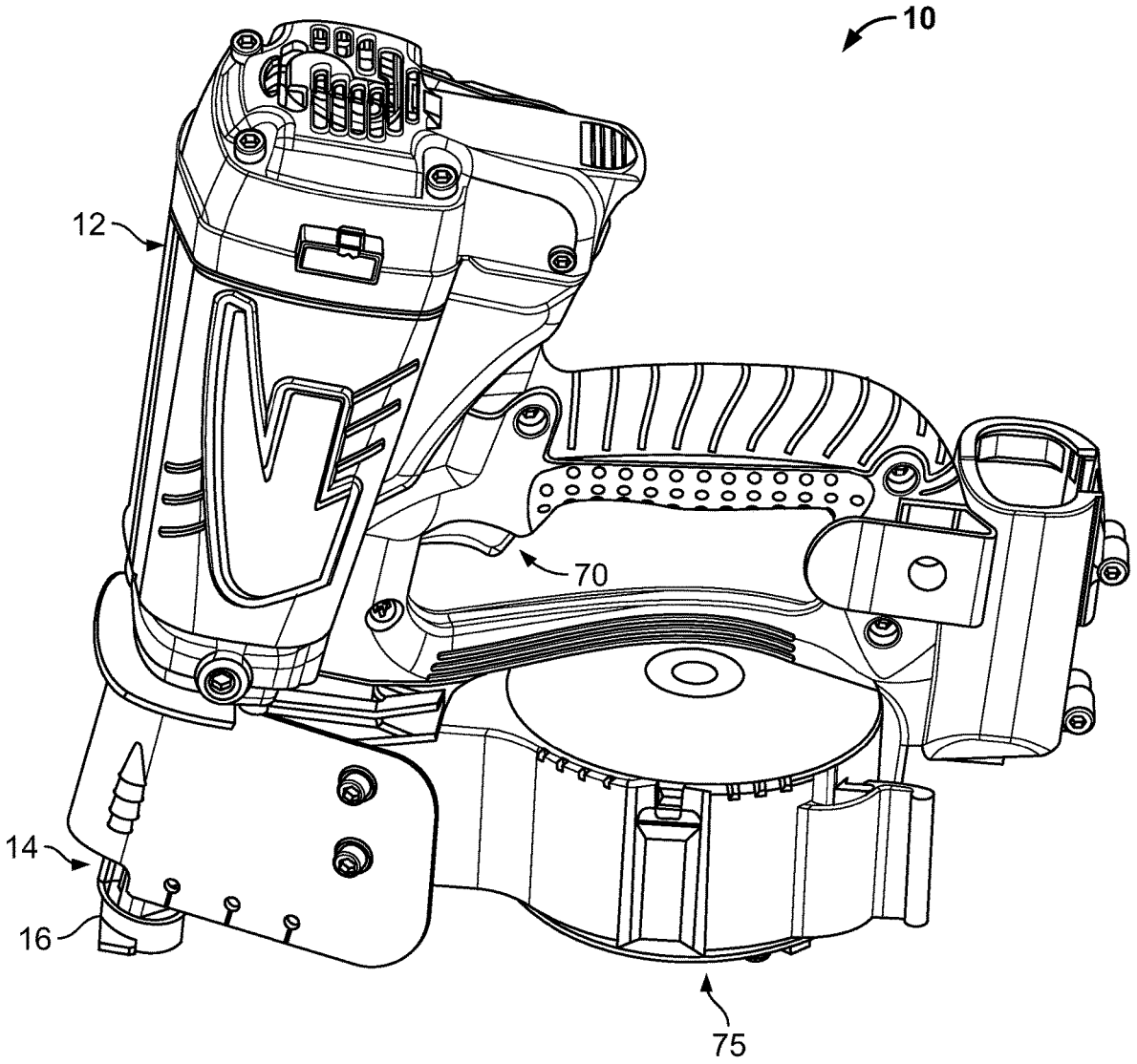
FIG. 1 is a perspective view of one embodiment of the combustion-powered-fastener-driving tool of the present disclosure.

FIGS. 1 to 11 illustrate one example embodiment of a combustion-powered-fastener-driving tool 10 of the present disclosure (sometimes called the "tool 10" for brevity). The tool 10 generally includes a multi-piece housing 12 (FIG. 1), an internal combustion assembly at least partially within the housing 12 (FIGS. 2 and 3), a nosepiece assembly 14 (FIG. 1) including a workpiece-contact element 16 (FIG. 1) supported by the housing 12, a trigger assembly 70 (FIGS. 1-11) supported by the housing 12, a lockout device 85 (FIGS. 2-11) supported by the housing 12, and a fastener magazine 75 (FIG. 1) supported by the housing 12 and connected to the nosepiece assembly 14.

Since certain portions of the fastener-driving tool—such as the housing 12, the nosepiece assembly 14 and workpiece-contact element 16, a fuel canister 200 and associated fuel delivery system, and the fastener magazine 75—are well-known in the art, they are only partially shown in certain drawings and generally described below (rather than in great detail) for clarity.

The tool 10 includes a cylinder 54 at least partially within and supported by the housing 12. A piston 55 is slidably disposed within the cylinder 54. An annular sealing element 57 (such as a steel ring) circumferentially extends around the periphery of the piston 55 and sealingly engages an inner cylindrical surface of the cylinder 54. A driver blade 56 is attached to and extends below the piston 55 (with respect to the orientation shown in FIGS. 2 and 3). A bumper 58 is positioned within and at the bottom of the piston 54. The bumper 58 is made of an elastomeric material in certain embodiments. As described in more detail below, the piston 55 (and attached driver blade 56) is movable relative to the cylinder 54 between a pre-firing position (FIG. 2) and a firing position (FIG. 3).

The cylinder 54 includes an exhaust check or petal valve 54*a* near its bottom and defines a vent port 54*b* below the exhaust check valve 54*a* (described below). The exhaust check valve 54*a* and the vent port 54*b* fluidically connect the cylinder 54 with the atmosphere. An annular sealing element 54*c* (such as an elastomeric o-ring) circumferentially extends around the outer periphery of the upper end (not labeled) of the cylinder 54.

Figure 2:
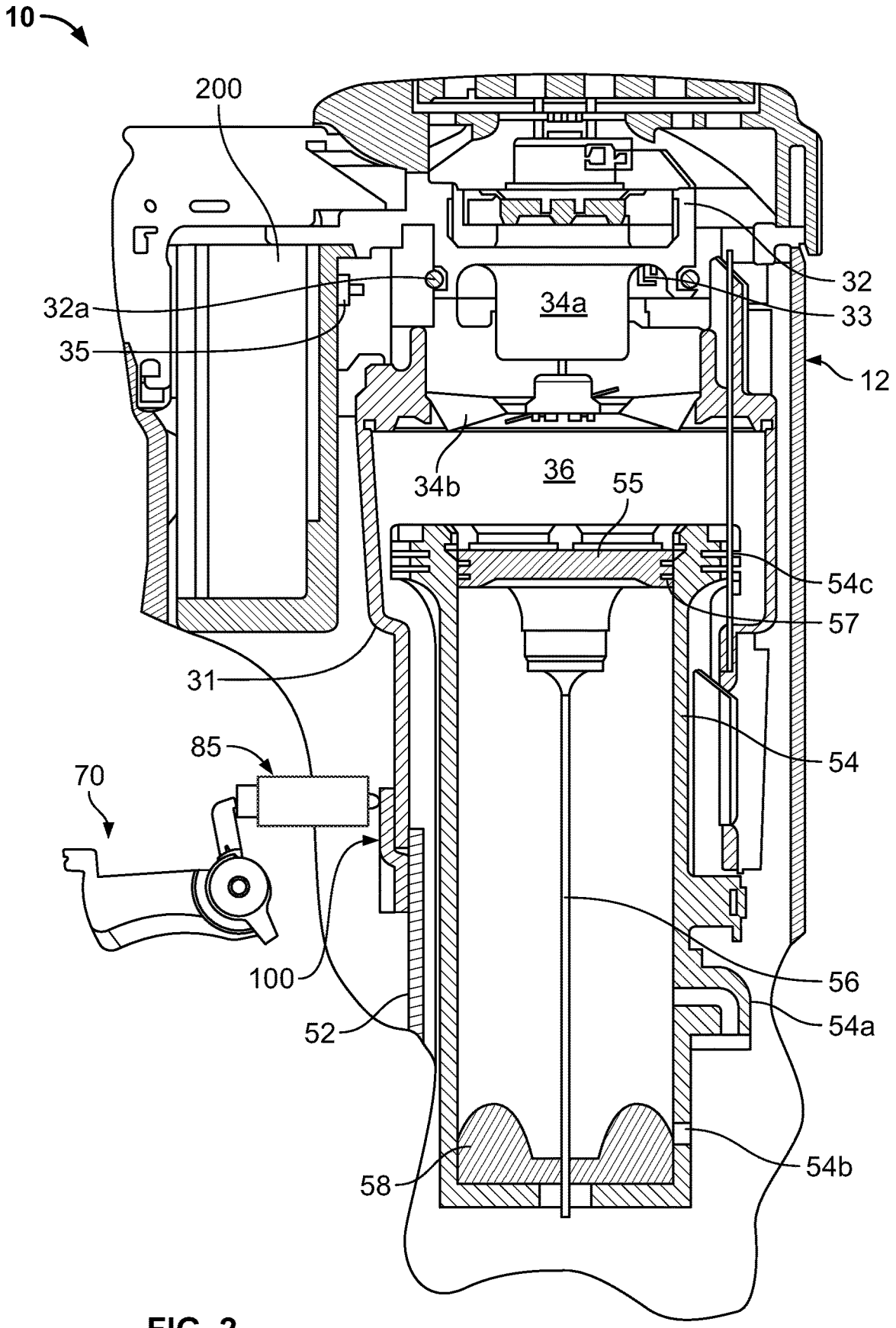
FIG. 2 is a fragmentary cross-sectional view of the tool of FIG. 1 with the valve sleeve in the unsealed position.
Figure 3:
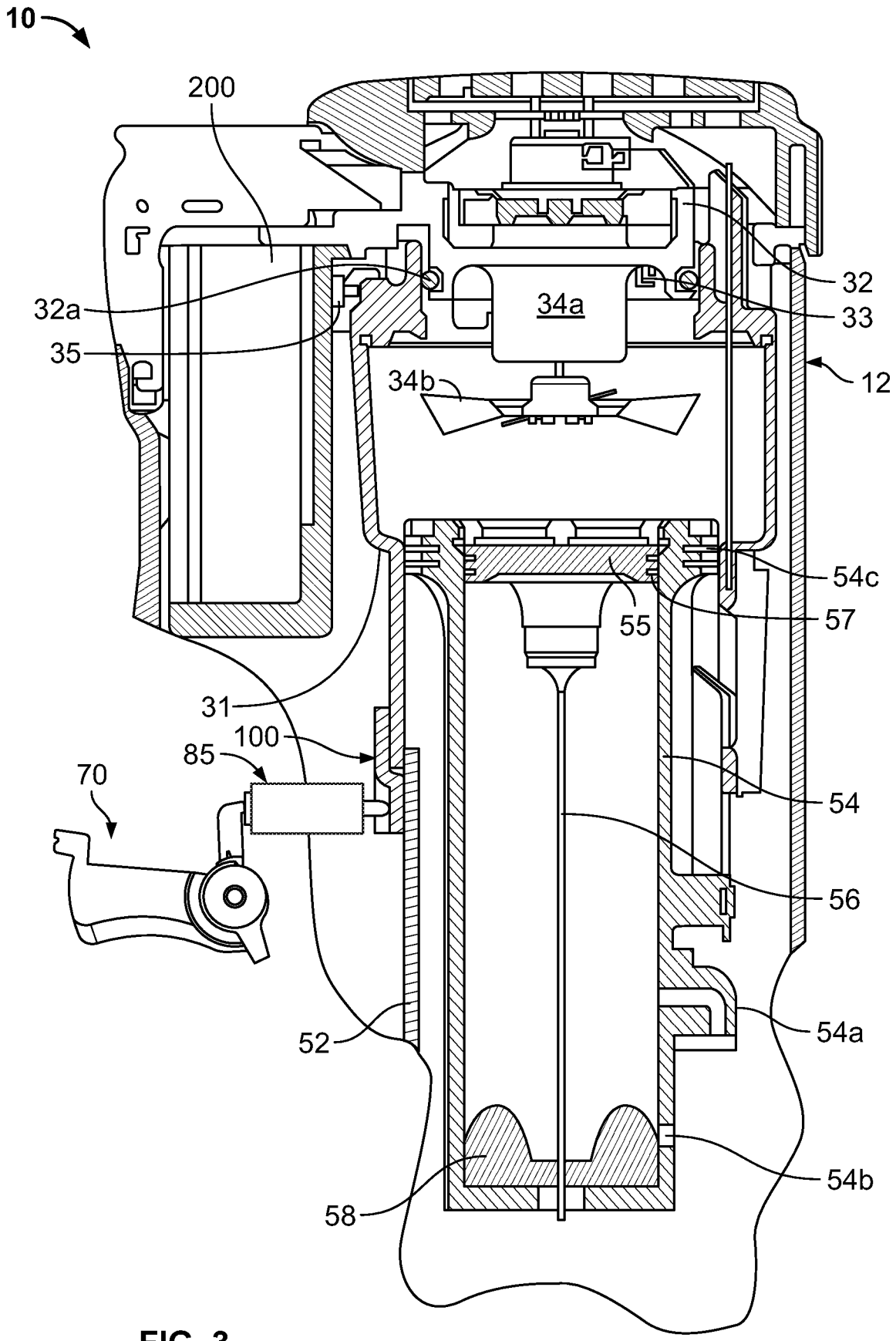
FIG. 3 is a fragmentary cross-sectional view of the tool of FIG. 1 with the valve sleeve in the sealed position.

A cylinder head 32 is at least partially within, supported by, and fixed relative to the housing 12 above the cylinder 54 (with respect to the orientation shown in FIGS. 2 and 3). A fan motor 34*a* is attached to the cylinder head 32. The fan motor 34*a* is drivingly engaged to a fan blade 34*b*. A spark plug 33 is also attached to the cylinder head 32. An annular sealing element 32*a* (such as a steel ring) extends around the periphery of an annular surface (not labeled) of the cylinder head 32.

A valve sleeve 31 is at least partially within, supported by, and movable relative to the housing 12. The valve sleeve 31 partially surrounds the cylinder 54. The valve sleeve 31 is movable relative to the housing 12, the cylinder head 32, and the cylinder 54 (among other components) between an unsealed position (FIG. 2) and a sealed position (FIG. 3).

The valve sleeve 31, the cylinder head 32, the cylinder 54, and the piston 55 collectively define a combustion chamber 36.

When the valve sleeve 31 is in the sealed position (FIG. 3), the combustion chamber is sealed because: (1) an upper annular portion of the valve sleeve 31 sealingly engages the annular sealing element 32*a* of the cylinder head 32; (2) a lower annular portion of the valve sleeve 31 sealingly engages the annular sealing element 54*c* of the cylinder 54; and (3) the annular sealing element 57 on the piston 55 sealingly engages the inner cylindrical surface of the cylinder 54.

Conversely, when the valve sleeve 31 is in the unsealed position (FIG. 2), the combustion chamber is unsealed sealed because: (1) the upper annular portion of the valve sleeve 31 is spaced apart from (i.e., does not sealingly engage) the annular sealing element 32*a* of the cylinder head 32; and (2) the lower annular portion of the valve sleeve 31 is spaced apart from (i.e., does not sealingly engage) the annular sealing element 54*c* of the cylinder 54.

A linkage 52 connects the valve sleeve 31 and the workpiece-contact element 16. As is known in the art, the workpiece-contact element 16 is movable relative to the housing 12, the cylinder head 32, and the cylinder 54 (among other elements) between an extended position and a retracted position. A biasing element (not shown), such as a spring, biases the workpiece contact element to the extended position. Movement of the workpiece-contact element 16 from the extended position to the retracted position causes the valve sleeve 31 (via the linkage 52) to move from the unsealed position to the sealed position, and vice-versa.

A retaining-pin receiver 100, described in detail below, is also attached to the valve sleeve 31. While the retaining-pin receiver 100 is attached to the bottom of the valve sleeve 31 in this illustrated embodiment, in other embodiments the retaining-pin receiver 100 may be attached to the valve sleeve 31 at any suitable location.

A fastener-driving cycle is now described. To start a fastener-driving cycle, an operator first depresses the workpiece-contact element 16 against a workpiece to move the workpiece-contact element 16 from the extended position to the retracted position. This causes: (1) the valve sleeve 31 to move (via the linkage 52) from the unsealed position to the sealed position to seal the combustion chamber 36; (2) a fuel canister 200 to dispense fuel into the combustion chamber 36 via a suitable fuel delivery system; and (3) the valve sleeve 31 to actuate a chamber switch 35.

Next, the operator pulls a trigger 71 of the trigger assembly 70 (described in detail below)—moving it from an extended position to a retracted position—to actuate a trigger switch (not shown), which causes the spark plug 33 to deliver a spark and ignite the fuel/air mixture in the combustion chamber 36. The fuel/air mixture explodes, thereby exerting pressure on the piston 55 and forcing the piston 55 (and attached driver blade 56) to move from the pre-firing position to the firing position. This causes the driver blade 56 to drive a fastener from the nosepiece into the workpiece. As the piston 55 travels toward the firing position, the piston 55 pushes air through the exhaust check valve 54*a* and the vent hole 54*b*. Once reaching the firing position, the piston 55 impacts the bumper 58. With the piston 55 beyond the exhaust check valve 54*a*, high pressure gasses vent from the cylinder 54 until near atmospheric pressure conditions are present and the check valve 54*a* closes. Due to internal pressure differentials in the cylinder 54, a vacuum is created above the piston 55, which sucks the piston 55 back to the pre-firing position, completing the fastener-driving cycle. The magazine 75 loads another fastener into the nosepiece assembly 14, and the operator can repeat the process.

As explained above, operation of a conventional combustion-powered-fastener-driving tool can be adversely affected if the valve sleeve moves and the combustion chamber unseals before the piston returns to the pre-firing position. The tool 10 solves this problem via a combination of the trigger assembly 70, the lockout device 85, and the retaining-pin receiver 100. Generally, and as described in more detail below, movement of the valve sleeve 31 to the sealed position aligns the retaining-pin receiver 100 with the lockout device 85 such that movement of the trigger 71 from the extended position to the retracted position causes the lockout device 85 to engage the retaining-pin receiver 100 until the trigger 71 moves back to the pre-firing position. While the lockout device 85 engages the retaining-pin receiver 100, the valve sleeve 31 cannot move back to the unsealed position, even if the workpiece contact element 16 is removed from the workpiece.

Figure 4:
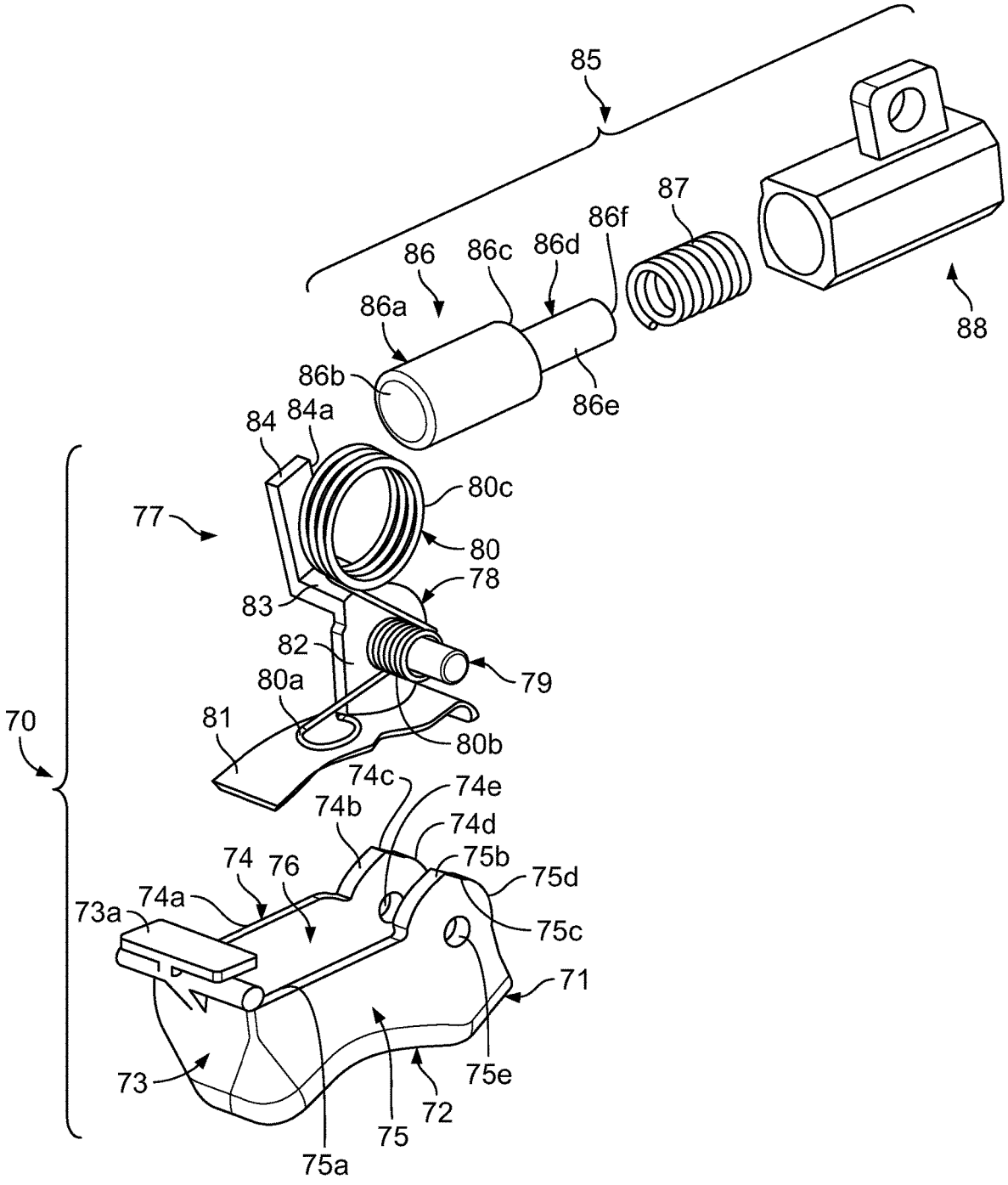
FIG. 4 is a partially exploded perspective view of the trigger assembly and the lockout device of the tool of FIG. 1.
Figure 5:
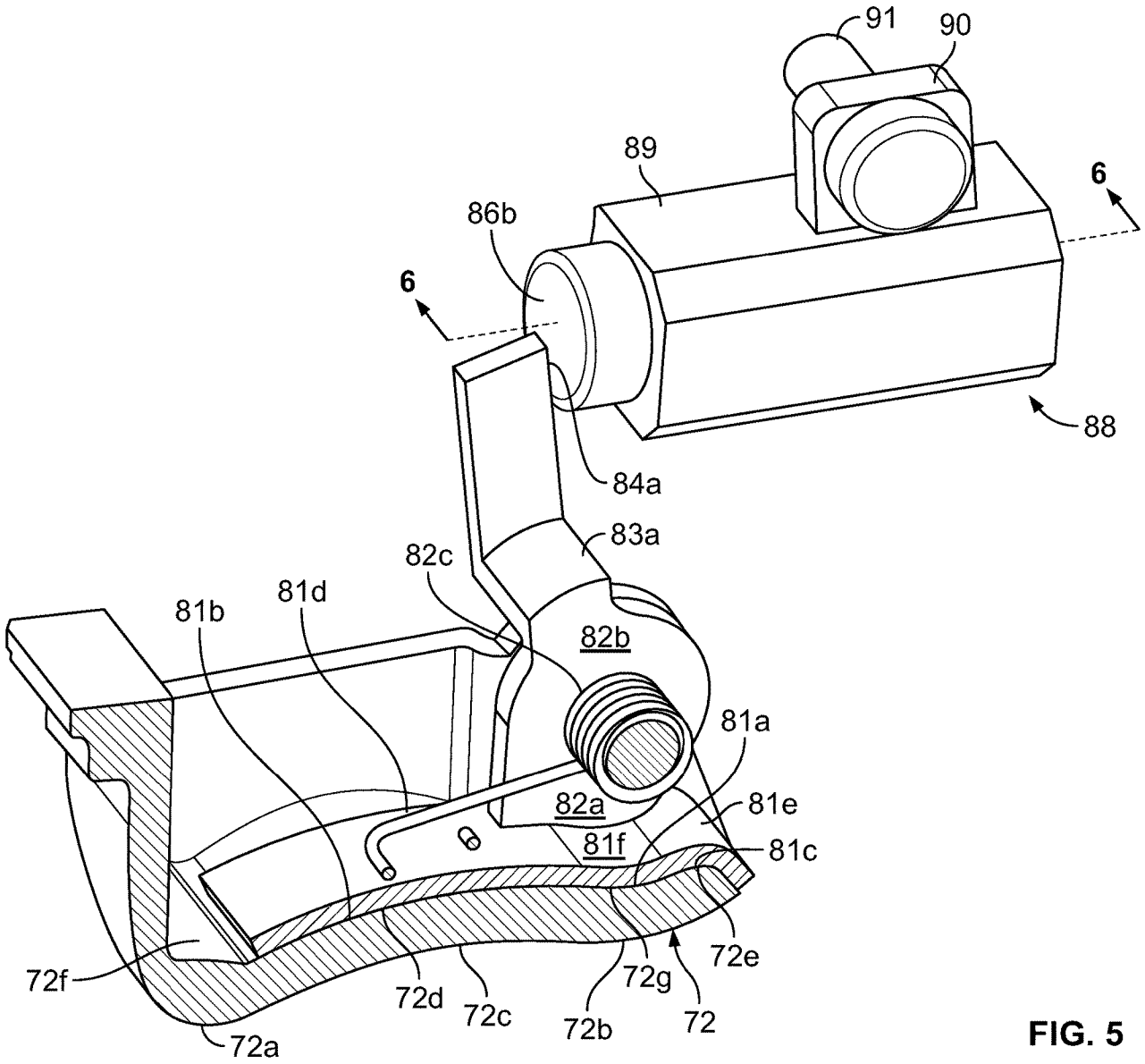
FIG. 5 is a perspective view of the lockout device of the tool of FIG. 1 and a cross-sectional perspective view of the trigger assembly of the tool of FIG. 1.
Figure 6:
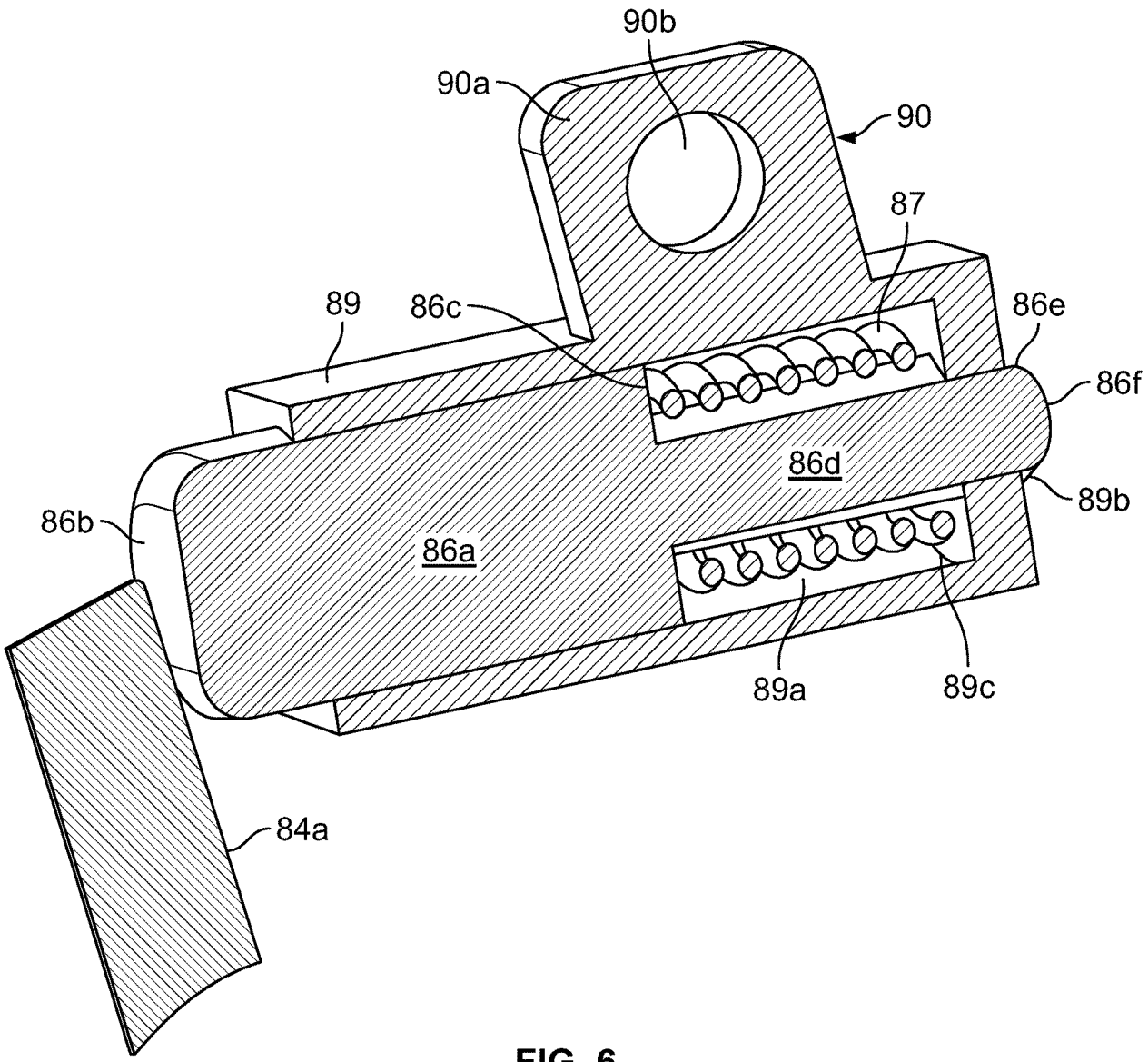
FIG. 6 is a fragmentary cross-sectional perspective view of the trigger assembly and the lockout device of the tool of FIG. 1 taken substantially along line 6-6 of FIG. 5.

FIGS. 4-6 show the trigger assembly 70 and the lockout device 85. The trigger assembly 70 includes the trigger 71 and a lever assembly 77.

The trigger 71 includes a bottom wall 72, a front wall 73, a left side wall 74, and a right side wall 75 defining an open cavity 76 therebetween.

The bottom wall 72 includes a nonlinear outer surface (not labeled) with apexes 72*a* and 72*b* and a finger valley 72*c* between the apexes 72*a* and 72*b*. The bottom wall 73 also includes a nonlinear inner surface (not labeled) with apexes 72*d* and 72*e*, a valley 72*f* between the apex 72*d* and the front wall 73, and a valley 72*g* between the apexes 72*d* and 72*e*.

The front wall 73 connects the left and right side walls 74 and 75 and the bottom wall 73. The front wall 73 includes a rotation-preventing foot 73*a*.

The left side wall 74 includes a top surface (not labeled) having a flat 74*a*, a first arc 74*b*, a shoulder 74*c*, and a second arc 74*d*. A radius of curvature of the first arc 74*b* exceeds a radius of curvature of the second arc 74*d*. The left side wall defines a pivot pin receiving hole 74*e* therethrough. The center of the pivot pin receiving hole 74*e* is generally coaxial with the centers of the radii of curvature of the first and second arcs 74*b* and 74*d* and is sized to receive a pivot pin 79 (described below) to facilitate mounting the trigger assembly 70 to the housing 12.

Similarly, the right side wall 75 includes a top surface (not labeled) having a flat 75*a*, a first arc 75*b*, a shoulder 75*c*, and a second arc 75*d*. A radius of curvature of the first arc 75*b* exceeds a radius of curvature of the second arc 75*d*. The right side wall defines a pivot pin receiving hole 75*e* therethrough. The center of the pivot pin receiving hole 75*e* is generally coaxial with the centers of the radii of curvature of the first and second arcs 75*b* and 75*d* and is sized to receive a pivot pin 79 (described below) to facilitate mounting the trigger assembly 70 to the housing 12.

The lever assembly 77 is fixedly attached to the trigger 71 and includes a lever body 78, the pivot pin 79, and a lever spring 80. The lever body 78 includes a trigger member 81, a first intermediate member 82, a second intermediate member 83, and a retainer-pin contact member 84.

The trigger member 81 includes a nonlinear bottom surface (not labeled) including an apex 81*a*, a valley 81*b* between the apex 81*a* and a first free end of the trigger member 81, and a valley 81*c* between the apex 81*a* and a second free end of the trigger member 81. The nonlinear bottom surface of the trigger tab 81 is flush with and attached to the nonlinear top surface of the trigger bottom wall 72, thus discouraging the trigger member 81 from sliding with respect to the trigger 71. These components may be attached in any suitable manner, such as via an adhesive or one or more fasteners. The trigger member 81 includes a nonlinear top surface (not labeled) including apexes 81*d* and 81*e* and a valley 81*f* between the apexes 81*d* and 81*e*.

The first intermediate member 82 is transverse to, such as generally perpendicular to, the trigger member 81. The combination of the trigger member 81 and the first intermediate member 82 generally form an "L" shape. The first intermediate member 82 includes a base 82*a* and a partial ring 82*b* that defines a pivot pin receiving hole 82*c* therethrough. The center of the pivot pin receiving hole 82*a* is generally coaxial with the center of the radius of curvature of the partial ring 82*b*. The first intermediate member 82 is partially positioned within the valley 81*f* of the trigger member 81, but does not contact the apexes 81*d* and 81*e*. A left side face (not labeled) of the intermediate member 82 lies flush against the inner face of the left side wall 74 of the trigger 71.

The second intermediate member 83 is transverse to, such as generally perpendicular to, the first intermediate member 82. More specifically, the second intermediate member extends generally perpendicularly from an upper portion of the partial ring 82*b* of the first intermediate member 82 in the direction of the left side wall 74 of the trigger 71. The combination of the first intermediate member 81 and the second intermediate member 82 generally form an "L" shape. The second intermediate member 83 includes an outwardly curved top surface 83*a*.

The retainer-pin contact member 84 is box shaped and transverse to, such as generally perpendicular to, the second intermediate member 82. More specifically, the retainer-pin contact member 84 extends from and generally perpendicularly to the free end of the second intermediate member 82 in a direction away from the trigger member 81. The retainer-pin contact member 84 is generally parallel to the first intermediate member 82. The combination of the second intermediate member 83 and the retainer-pin contact member 84 generally form an "L" shape.

The lever spring 80 includes a trigger coil 80*a*, a pin coil 80*b*, and a housing coil 80*c*. The grip coil 80*a* includes a single winding that contacts apex 81*d* of the trigger member 81. The pin coil 80*b* includes multiple windings that define a pivot pin receiving opening (not labeled). The housing coil 80*c* also includes multiple windings.

The pivot pin 79 is cylindrical and extends through the pivot pin receiving holes 74*e*, 82*c*, and 75*e* of the left side wall 74, the first intermediate member 82, and the right side wall 75, respectively. The pivot pin 79 also extends through the pivot pin receiving opening of the pin coil 80*b* so the pin coil 80*b* is rotatably mounted to the pivot pin 79.

The lockout device 85 includes a retainer pin 86, a retainer spring 87, and a guide 88.

The retainer pin 86 includes a cylindrical base 86*a* and a cylindrical tip 86*d*. The outer diameter of the base 86*a* is larger than the outer diameter of the tip 86*d*. The base 86*a* has a circular flat front surface 86*b* for contacting retainer-pin contact member 84 (as described below) and a flat rear surface 86*c* from which the tip 86*d* extends. Due to the difference in outer diameters of the tip 86*d* and the base 86*a*, the exposed portion of the rear surface 86*c* is annular. The tip 86*d* includes an outer surface 86*e* and a rear surface 86*f*.

The guide 88 supports and houses the retainer pin 86 and the retainer spring 87. The guide 88 includes a housing 89 and a mount 90. The housing 89 defines a cylindrical blind bore 89*a* and a cylindrical throughbore 89*b*. The diameter of the blind bore 89*a* is larger than the diameter of the throughbore 89*b*. More specifically, the diameter of the blind bore 89*a* is just larger than the diameter of the outer base 86*a* of the retainer pin 86, and the diameter of the throughbore 89*b* is just larger than the outer diameter of the tip 86*b* of the retainer pin 86.

A rear end of cylindrical blind bore 89*a* terminates at an annular inner front surface 89*c*, through which the throughbore 89*b* is defined. The longitudinal axes of the blind bore 89*a* and the throughbore 89*b* are generally coaxial. The housing 89 includes flat and rectangular outer main surfaces 89*d*, 89*e*, 89*f*, and 89*g* and flat and rectangular outer chamfers (not labeled). Each chamfer connects two adjacent main surfaces. Each chamfer is oriented at a forty-five degree angle with respect to the two adjacent main surfaces, though any other suitable angles may be used.

When assembled, the retainer spring 87 is wound about the tip 86*d* of the retainer pin 86, and the retainer pin 86 is partly inserted into the blind bore 89*a* such that the retainer spring 87 is seated between the rear surface 86*c* of the retainer pin 86 and the inner front surface 89*c* of the guide 88. The retainer pin 86 is movable relative to the guide from a retracted position in which the retainer spring 87 is extended and the tip 86*d* slightly protrudes from the throughbore 89*b* to an engaged position in which the retainer spring 87 is compressed and the tip protrudes further from the throughbore 89*b*. The retainer spring 87 biases the retainer pin 86 to the retracted position.

Figure 7:
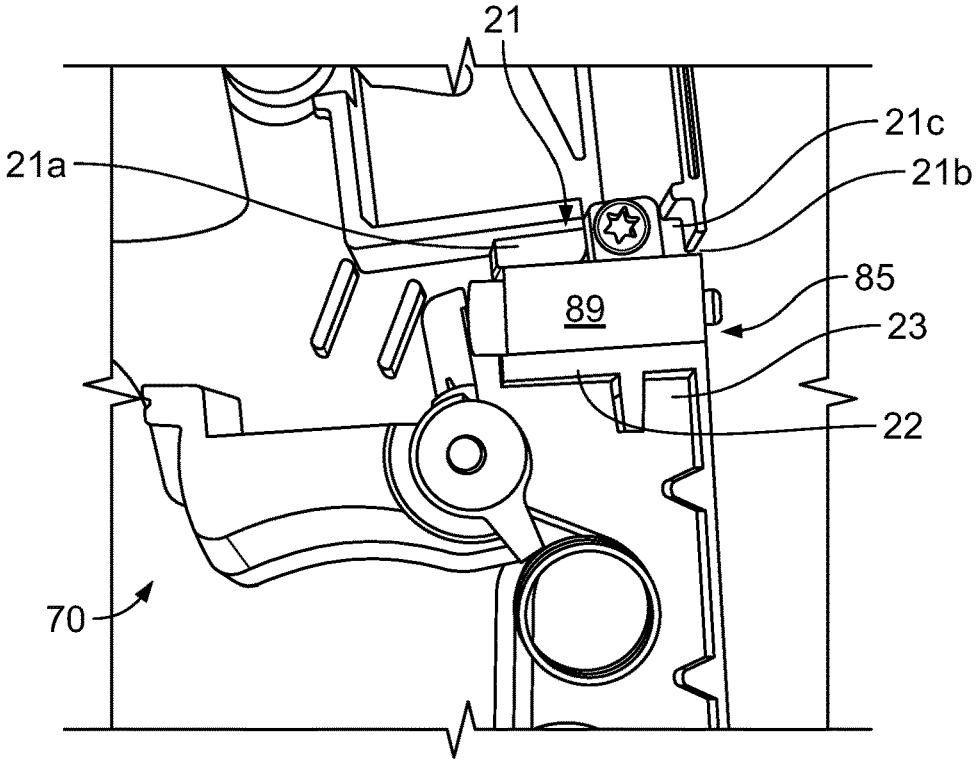
FIG. 7 is a fragmentary perspective view of the trigger assembly and the lockout device of the tool of FIG. 1 within the housing of the tool of FIG. 1 in which the trigger of the trigger assembly is in the extended position and the retaining pin of the lockout device is in the retracted position.
Figure 8:
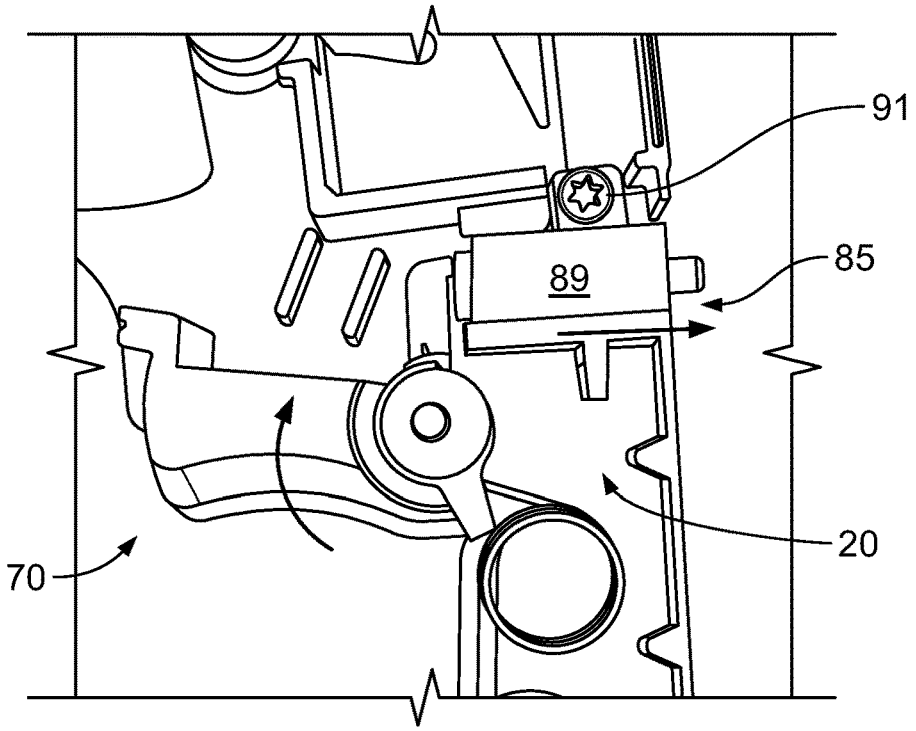
FIG. 8 is a fragmentary perspective view of the trigger assembly and the lockout device of the tool of FIG. 1 within the housing of the tool of FIG. 1 in which the trigger of the trigger assembly is in the retracted position and the retaining pin of the lockout device is in the engaged position.

FIGS. 7 and 8 show how the trigger assembly 70 and the lockout device 85 are mounted to the housing 12.

The pivot pin 79 is attached to the housing 12 to rotatably mount the trigger assembly 70 to the housing 12 such that the trigger 71 (and the lever assembly 77 fixedly attached thereto) is rotatable relative to the housing 12 between the extended position and the retracted position.

The lockout device 85 is attached to the housing 12 via the mount 90. The mount 90 perpendicularly extends from the top outer surface 89*d* of the guide housing 89. The mount 90 includes a body 90*a* defining a cylindrical mounting opening 90*b*. A longitudinal axis of the mounting opening 90*b* extends in perpendicular to the longitudinal axes of the bores 89*a* and 89*b*. The housing 12 includes flat opposing top and bottom walls 21 and 22 and a flat left wall 23. Together, the walls 21, 22 and 23 define a cavity (not labeled) sized to receive the housing 89. The housing 90 is located in this cavity, and a fastener 91 inserted through the mounting opening 90*b* threadably engages a threaded blind bore (not shown) defined in the housing 12 to secure the lockout device to the housing 12.

Once attached to the housing, the retainer spring 87 biases the retainer pin 86 to the retracted position in which the flat front surface 86*b* contacts the retainer-pin contact member 84 of the lever assembly 77. Since the lever assembly 77 is fixedly attached to the trigger 71, the retainer spring 87 biases the trigger 71 to the extended position. The rotation-preventing foot 73*a* contacts one or more components of the housing 12 to stop the trigger 71 from rotating once it reaches the extended position.

When the trigger assembly 70 is mounted to the housing 12, the grip coil 80*a* firmly contacts the trigger member 81 and the housing coil 80*c* firmly contacts a portion of the housing. The lever spring 80 applies increasing force that biases the trigger 71 to the extended position as the trigger 71 moves from the extended position to the retracted position. In some embodiments, the lever spring 80 also biases the trigger 71 to the extended position while the trigger 71 is in the extended position.

When the trigger 71 moves from the extended position (FIG. 7) to the retracted position (FIG. 8), the lever assembly 77 rotates with the trigger 71, and the retainer-pin contact member 84 (and particularly a retainer-pin contact surface 84*a*) contacts the flat front surface 86*b* of the retainer pin 86, thereby forcing the retainer pin 86 to move from the retracted position to the engaged position. As shown in FIG. 8, the tip 86*d* of the retainer pin 86 protrudes from the housing 89 when in the engaged position.

Figure 9:
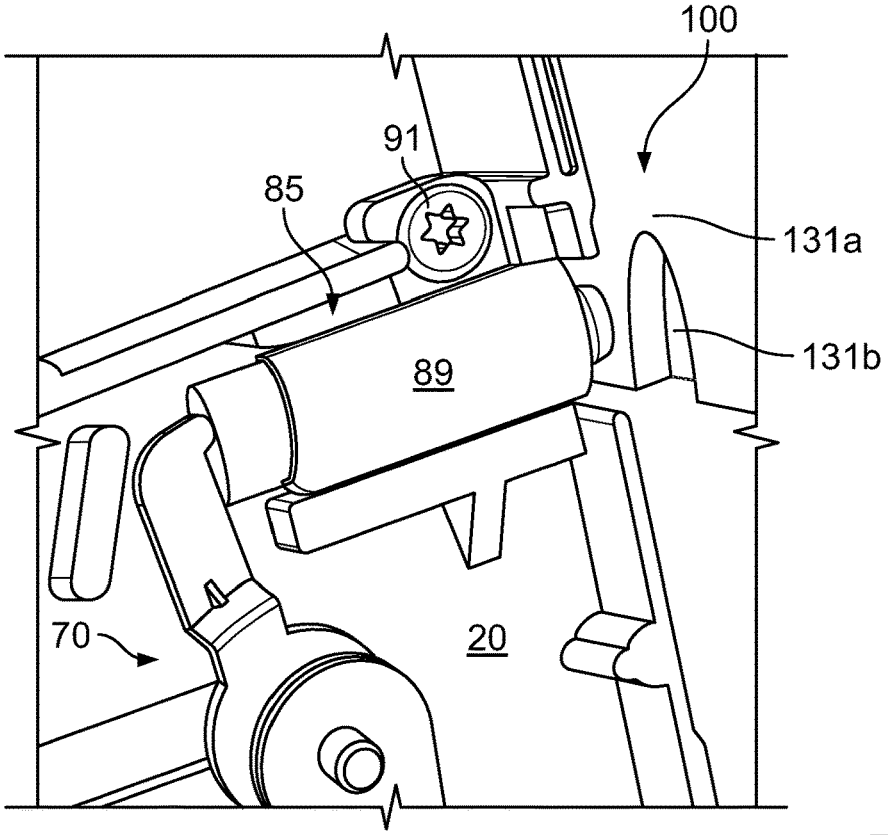
FIG. 9 is a fragmentary perspective view of the trigger assembly and the lockout device of the tool of FIG. 1 within the housing of the tool of FIG. 1 and adjacent the retaining-pin receiver of the tool of FIG. 1 in which the trigger of the trigger assembly is in the extended position and the retaining pin of the lockout device is in the retracted position.
Figure 10:
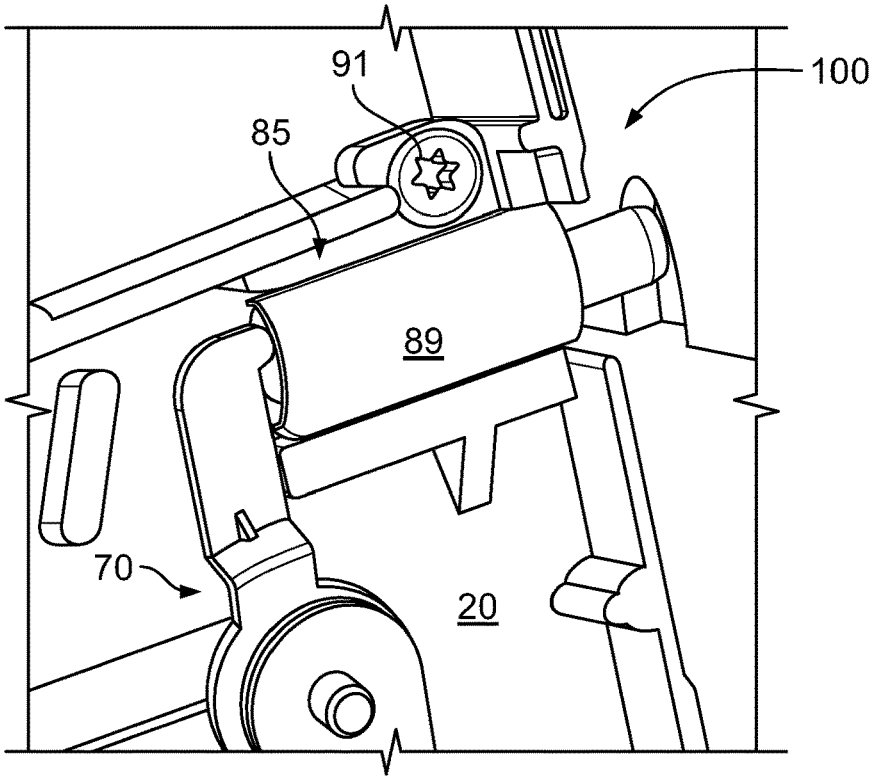
FIG. 10 is a fragmentary perspective view of the trigger assembly and the lockout device of the tool of FIG. 1 within the housing of the tool of FIG. 1 and adjacent the retaining-pin receiver of the tool of FIG. 1 in which the trigger of the trigger assembly is in the retracted position and the retaining pin of the lockout device is in the engaged position and received by the retaining-pin receiver.

FIGS. 9 and 10 show the locations of the trigger assembly 70 and the lockout device 85 relative to the valve sleeve 31 and the retaining-pin receiver 100.

Figure 11:
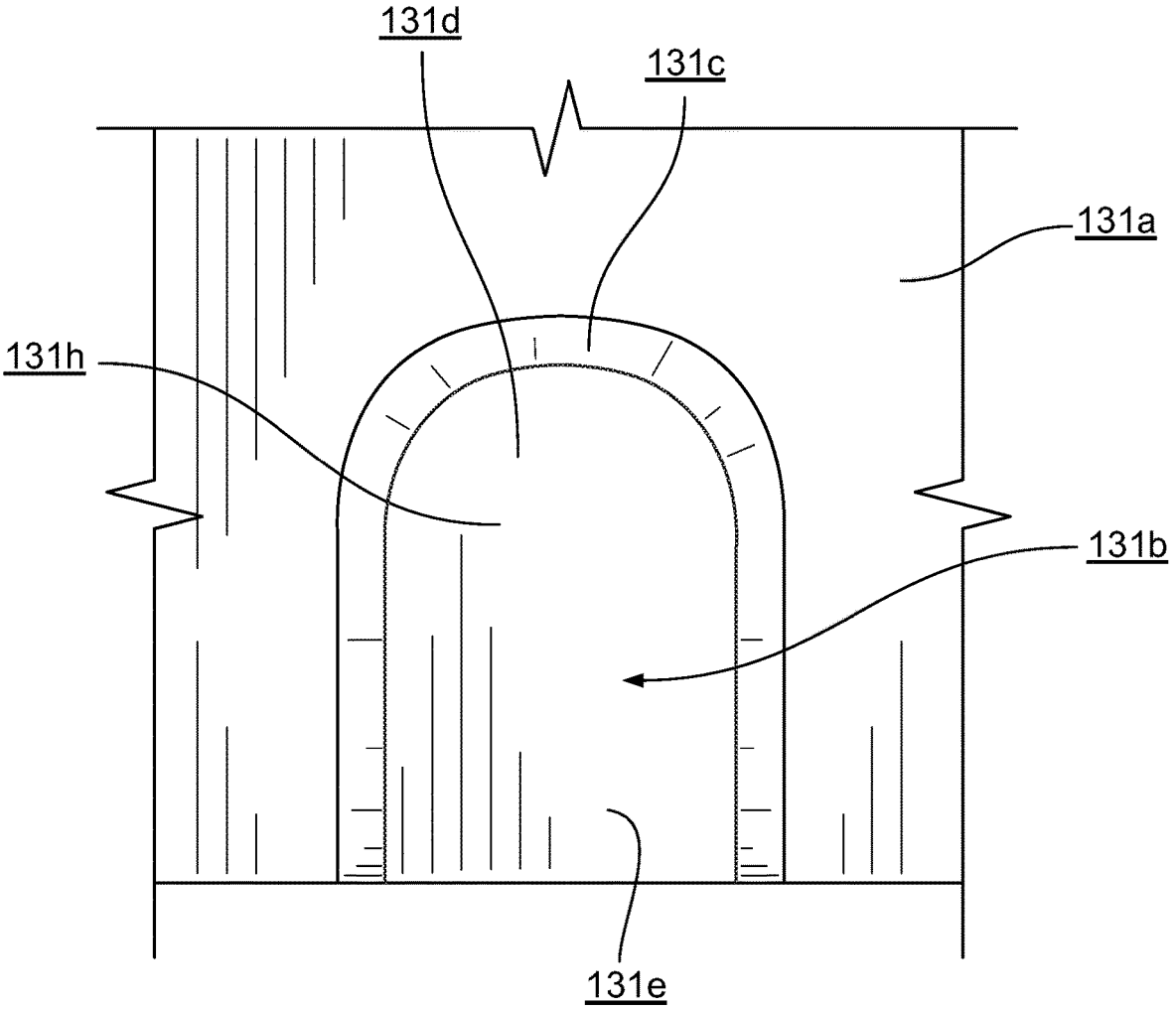
FIG. 11 is a fragmentary front elevational view of the retaining-pin receiver of the tool of FIG. 1.

FIG. 11 shows part of the retaining-pin receiver 100. The retaining-pin receiver 100 has an outer surface 131*a* that defines a groove 131*b* having by one or more inner surfaces 131*c* and a flat base surface 131*h*. The combination of inner surfaces 131*c* forms a "U" shape. As such, the groove 131*b* includes a longitudinally closed end 131*d* and a longitudinally open end 131*e*. As shown in FIGS. 2 and 3, the retaining-pin receiver 100 is fixedly attached to the valve sleeve 31 and/or the linkage 52 in any suitable manner, such as via one or more fasteners. In other embodiments, the groove 131*b* is defined in the valve sleeve itself, in which case there is no need for a separate retaining-pin receiver 100.

When the lockout device 85 is in the retracted position, the valve sleeve 31 may move between the unsealed and sealed positions. When the lockout device 85 is in the engaged position, the valve sleeve 31 may move from the unsealed position to the sealed position, but may not move from the sealed position to the unsealed position.

When the valve sleeve 31 is in the unsealed position and the trigger 71 is pulled, the retainer pin 86 contacts the outer surface 131*a* of the retaining-pin receiver 100. Thus, besides exerting a negligible frictional force on the outer surface 131*a*, the retainer pin 86 does not affect movement of the valve sleeve 31 from the unsealed position to the sealed position. As such, the retainer pin 86 occupies an intermediate position. In to some embodiments, pulling the trigger 71 until the retainer pin 86 contacts the outer surface 131*a* of the retaining-pin receiver 100 does not actuate the trigger switch (e.g., does not cause the trigger to move all the way to the retracted position).

As shown in FIG. 9 (and FIG. 3), when the valve sleeve 31 is in the sealed position, either notch 131*b* is radially aligned with the retainer pin 86. Moving the trigger 71 from the extended position to the retracted position causes the retainer pin 86 to move from the retracted position to the engaged position. When the valve sleeve 31 is in the sealed position and the retainer pin 86 is in the engaged position, the outer surface 86*e* of the top 86*d* of the retainer pin 86 enters the groove 131*b* and contacts the retaining-pin receiver 100, as shown in FIG. 10 (and FIG. 2). While in this configuration, the retainer pin 86 prevents the valve sleeve from moving from the sealed position to the unsealed position. By virtue of open end 131*e* of the groove 131*b*, the valve sleeve 31 may still move longitudinally upward relative to the cylinder head 32.

A fastener-driving cycle is now described. To start a fastener-driving cycle, an operator first depresses the workpiece-contact element 16 against a workpiece to move the workpiece-contact element 16 from the extended position to the retracted position. This causes: (1) the valve sleeve 31 to move (via the linkage 52) from the unsealed position to the sealed position to seal the combustion chamber 36 and to align the groove 131*b* of the retaining-pin receiver 100 with the retainer pin 86; (2) a fuel canister 200 to dispense fuel into the combustion chamber 36 via a suitable fuel delivery system; and (3) the valve sleeve 31 to actuate a chamber switch 35.

Next, the operator pulls the trigger 71—moving it from the extended position to the retracted position—to actuate a trigger switch (not shown), which causes the spark plug 33 to deliver a spark and ignite the fuel/air mixture in the combustion chamber 36. Movement of the trigger 71 to the retracted position also causes the retainer pin 86 to enter the groove 131*b* of the retaining-pin receiver 100. The fuel/air mixture explodes, thereby exerting pressure on the piston 55 and forcing the piston 55 (and attached driver blade 56) to move from the pre-firing position to the firing position. This causes the driver blade 56 to drive a fastener from the nosepiece into the workpiece. As the piston 55 travels toward the firing position, the piston 55 pushes air through the exhaust check valve 54*a* and the vent hole 54*b*. Once reaching the firing position, the piston 55 impacts the bumper 58. With the piston 55 beyond the exhaust check valve 54*a*, high pressure gasses vent from the cylinder 54 until near atmospheric pressure conditions are present and the check valve 54*a* closes. Due to internal pressure differentials in the cylinder 54, a vacuum is created above the piston 55, which sucks the piston 55 back to the pre-firing position, completing the fastener-driving cycle. The magazine 75 loads another fastener into the nosepiece assembly 14, and the operator can repeat the process.

So long as the operator holds the trigger 71 in the retracted position, the valve sleeve 31 cannot move to the unsealed position (due to the retainer pin 86 in the groove 131*b*) to prematurely unseal the combustion chamber 36. This is true even if the operator removes the workpiece contact element 16 from the workpiece, causing it to move to the extended position. The lockout device 85 therefore solves the above-described problems by enabling an operator to control unsealing of the combustion chamber via trigger actuation.

Although not shown, in certain embodiments the side of the retainer-pin contact member 84 opposite the front wall 73 of the trigger 71 includes a retainer-pin contact foot. In some of these embodiments, the retainer-pin contact foot has a cam surface that, in operation, contacts the retainer-pin when the trigger 71 is moved from the extended position to the retracted position.

It should be appreciated from the above that various embodiments of the present disclosure provide combustion-powered-fastener-driving tool comprising: a housing; a valve sleeve at least partially within the housing and movable relative to the housing between an unsealed position and a sealed position; a trigger supported by the housing and movable relative to the housing between an extended position and a retracted position; a retainer pin movable relative to the housing between a retracted position and an engaged position; a retainer pin receiver; and a retainer pin contact member positioned relative to the retainer pin and operably connected to the trigger such that, when the valve sleeve is in the sealed position and the trigger moves from the extended position to the retracted position, the retainer pin contact member engages the retainer pin and moves the retainer pin from the retracted position to the engaged position such that part of the retainer pin is received by the retainer pin receiver and prevents the valve sleeve from moving from the sealed position to the unsealed position.

In various such embodiments, the tool includes a biasing member that biases the retainer pin to the retracted position.

In various such embodiments of the tool, the retainer pin contact member is positioned relative to the retainer pin such that the retainer pin contact member engages the retainer pin when the retainer pin is in the retracted position.

In various such embodiments of the tool, the retainer pin receiver defines an opening sized to receive the part of the retainer pin.

In various such embodiments of the tool, the retainer pin receiver is movable relative to the retainer pin between a first position in which the opening is not positioned to receive the part of the retainer pin and a second position in which the opening is positioned to receive the part of the retainer pin.

In various such embodiments of the tool, the retainer pin receiver is connected to the valve sleeve such that the retainer pin receiver is movable with the valve sleeve.

In various such embodiments, the tool includes a workpiece contact element movable relative to the housing between an extended position and a retracted position, wherein the workpiece contact element is connected to the valve sleeve via a linkage such that movement of the workpiece contact element from the extended position to the retracted position causes the valve sleeve to move from the unsealed position to the sealed position and the retainer pin receiver to move from the first position to the second position.

In various such embodiments of the tool, the retainer pin receiver is integral with the valve sleeve and the opening is defined in an outer surface of the valve sleeve.

In various such embodiments of the tool, the retainer pin contact member is positioned relative to the retainer pin and operatively connected to the trigger such that, when the valve sleeve is in the unsealed position, the trigger cannot move from the extended position to the retracted position.

In various such embodiments, the tool includes a biasing member that biases the trigger to the extended position.

It should also be appreciated from the above that various embodiments of the present disclosure provide a combustion-powered-fastener-driving tool comprising: a valve sleeve movable between an unsealed position and a sealed position; a trigger movable between an extended position and a retracted position; a retainer pin movable between a retracted position and an engaged position; a retainer pin receiver; and a retainer pin contact member operably connected to the trigger, wherein in a pre-firing configuration, the valve sleeve is in the unsealed position, the trigger is in the extended position, and the retainer pin is the retracted position, wherein in a firing position, the valve sleeve is in the sealed position, the trigger is in the retracted position, and the retainer pin is in the extended position such that part of the retainer pin is received by the retainer pin receiver and prevents the valve sleeve from moving from the sealed position to the unsealed position.

In various such embodiments, the tool includes a biasing member that biases the retainer pin to the retracted position.

In various such embodiments of the tool, the retainer pin contact member is positioned relative to the retainer pin such that the retainer pin contact member engages the retainer pin when the retainer pin is in the retracted position.

In various such embodiments of the tool, the retainer pin receiver defines an opening sized to receive the part of the retainer pin.

In various such embodiments of the tool, the retainer pin receiver is movable relative to the retainer pin between a first position in which the opening is not positioned to receive the part of the retainer pin and a second position in which the opening is positioned to receive the part of the retainer pin.

In various such embodiments of the tool, the retainer pin receiver is connected to the valve sleeve such that the retainer pin receiver is movable with the valve sleeve.

In various such embodiments, the tool includes a workpiece contact element movable relative to the housing between an extended position and a retracted position, wherein the workpiece contact element is connected to the valve sleeve via a linkage such that movement of the workpiece contact element from the extended position to the retracted position causes the valve sleeve to move from the unsealed position to the sealed position and the retainer pin receiver to move from the first position to the second position.

In various such embodiments of the tool, the retainer pin receiver is integral with the valve sleeve and the opening is defined in an outer surface of the valve sleeve.

In various such embodiments of the tool, the retainer pin contact member is positioned relative to the retainer pin and operatively connected to the trigger such that, when the valve sleeve is in the unsealed position, the trigger cannot move from the extended position to the retracted position.

In various such embodiments, the tool includes a biasing member that biases the trigger to the extended position.

Various modifications to the above-described embodiments will be apparent to those skilled in the art. These modifications can be made without departing from the spirit and scope of this present subject matter and without diminishing its intended advantages. Not all of the depicted components described in this disclosure may be required, and some implementations may include additional, different, or fewer components as compared to those described herein. Variations in the arrangement and type of the components; the shapes, sizes, and materials of the components; and the manners of attachment and connections of the components may be made without departing from the spirit or scope of the claims set forth herein. Also, unless otherwise indicated, any directions referred to herein reflect the orientations of the components shown in the corresponding drawings and do not limit the scope of the present disclosure. This specification is intended to be taken as a whole and interpreted in accordance with the principles of the invention as taught herein and understood by one of ordinary skill in the art.

The invention claimed is:

1. A combustion-powered-fastener-driving tool comprising:

a housing;

a valve sleeve at least partially within the housing and movable relative to the housing from an unsealed position to a sealed position and back to the unsealed position;

a trigger supported by the housing and movable relative to the housing from an extended position to a retracted position and back to the extended position;

a first biasing member that biases the trigger to the extended position;

a guide housing connected to the housing, the guide housing including a plurality of interior surfaces that define a guide housing bore;

a retainer pin supported within at least a portion of the guide housing bore and movable relative to the guide housing from a retracted position to an engaged position and back to the retracted position;

a second biasing member disposed within the guide housing bore and engaged with the retainer pin and one of the plurality of interior surfaces to bias the retainer pin to the retracted position;

a retainer pin receiver; and a retainer pin contact member positioned relative to the retainer pin and operably connected to the trigger such that, when the valve sleeve is in the sealed position and the trigger moves from the extended position to the retracted position, the retainer pin contact member engages the retainer pin and moves the retainer pin from the retracted position to the engaged position such that a part of the retainer pin is received by the retainer pin receiver and prevents the valve sleeve from moving from the sealed position back to the unsealed position, and wherein the retainer pin contact member is positioned relative to the retainer pin and operatively connected to the trigger such that when the valve sleeve is in the unsealed position the trigger cannot move from the extended position to the retracted position.

2. The tool of claim 1, wherein the retainer pin contact member is positioned relative to the retainer pin such that the retainer pin contact member engages the retainer pin when the retainer pin is in the retracted position.

3. The tool of claim 1, wherein the retainer pin receiver defines an opening sized to receive the part of the retainer pin.

4. The tool of claim 3, wherein the retainer pin receiver is movable relative to the retainer pin from a first position in which the opening is not positioned to receive the part of the retainer pin to a second position in which the opening is positioned to receive the part of the retainer pin and back to the first position.

5. The tool of claim 4, wherein the retainer pin receiver is connected to the valve sleeve such that the retainer pin receiver is movable with the valve sleeve.

6. The tool of claim 5, which includes a workpiece contact element movable relative to the housing from an extended position to a retracted position and back to the extended position, wherein the workpiece contact element is connected to the valve sleeve via a linkage such that movement of the workpiece contact element from the extended position to the retracted position causes the valve sleeve to move from the unsealed position to the sealed position and the retainer pin receiver to move from the first position to the second position.

7. The tool of claim 6, wherein the retainer pin receiver is integral with the valve sleeve and the opening is defined in an outer surface of the valve sleeve.

8. A combustion-powered-fastener-driving tool comprising:

a valve sleeve movable from an unsealed position to a sealed position and back to the unsealed position;

a trigger movable from an extended position to a retracted position and back to the extended position;

a first biasing member that biases the trigger to the extended position;

a guide housing connected to a tool housing, the guide housing including a plurality of interior surfaces that define a guide housing bore;

a retainer pin supported within at least a portion of the guide housing bore and movable relative to the guide housing from a retracted position to an engaged position and back to the retracted position;

a second biasing member disposed within the guide housing bore and engaged with the retainer pin and one of the plurality of interior surfaces to bias the retainer pin to the retracted position;

a retainer pin receiver; and a retainer pin contact member operably connected to the trigger such that when the valve sleeve is in the unsealed position the trigger cannot move from the extended position to the retracted position, wherein in a pre-firing configuration, the valve sleeve is in the unsealed position, the trigger is in the extended position, and the retainer pin is the retracted position, wherein in a firing position, the valve sleeve is in the sealed position, the trigger is in the retracted position, and the retainer pin is in the engaged position such that part of the retainer pin is received by the retainer pin receiver and prevents the valve sleeve from moving from the sealed position to the unsealed position.

9. The tool of claim 8, wherein the retainer pin contact member is positioned relative to the retainer pin such that the retainer pin contact member engages the retainer pin when the retainer pin is in the retracted position.

10. The tool of claim 8, wherein the retainer pin receiver defines an opening sized to receive the part of the retainer pin.

11. The tool of claim 10, wherein the retainer pin receiver is movable relative to the retainer pin from a first position in which the opening is not positioned to receive the part of the retainer pin to a second position in which the opening is positioned to receive the part of the retainer pin and back to the first position.

12. The tool of claim 11, wherein the retainer pin receiver is connected to the valve sleeve such that the retainer pin receiver is movable with the valve sleeve.

13. The tool of claim 12, which includes a workpiece contact element movable relative to a housing of the tool from an extended position to a retracted position and back to the extended position, wherein the workpiece contact element is connected to the valve sleeve via a linkage such that movement of the workpiece contact element from the extended position to the retracted position causes the valve sleeve to move from the unsealed position to the sealed position and the retainer pin receiver to move from the first position to the second position.

14. The tool of claim 13, wherein the retainer pin receiver is integral with the valve sleeve and the opening is defined in an outer surface of the valve sleeve.

* * * * *